US012638264B2

(12) United States Patent
Walterscheit, Jr.

(10) Patent No.: US 12,638,264 B2
(45) Date of Patent: May 26, 2026

(54) ARROW REST LAUNCHER ACCESSORY

(71) Applicant: Jon P Walterscheit, Jr., Marshall, WI (US)

(72) Inventor: Jon P Walterscheit, Jr., Marshall, WI (US)

( * ) Notice: Subject to any disclaimer, the term of this patent is extended or adjusted under 35 U.S.C. 154(b) by 171 days.

(21) Appl. No.: 18/795,479

(22) Filed: Aug. 6, 2024

(65) Prior Publication Data

US 2025/0052533 A1 Feb. 13, 2025

Related U.S. Application Data

(60) Provisional application No. 63/531,040, filed on Aug. 7, 2023.

(51) Int. Cl.
*F41B 5/14* (2006.01)

(52) U.S. Cl.
CPC ..... *F41B 5/143* (2013.01)

(58) Field of Classification Search
CPC ..... F42B 5/143
USPC ..... 124/44.5
See application file for complete search history.

(56) References Cited

U.S. PATENT DOCUMENTS 3,494,347 A * 2/1970 Saunders ..... F41B 5/143 124/44.5
5,353,778 A * 10/1994 Blankenship ..... F41B 5/143 124/44.5
7,021,301 B2 * 4/2006 Nagle ..... F41B 5/143 124/44.5
8,701,643 B2 * 4/2014 Ellig ..... F41B 5/143 124/44.5

OTHER PUBLICATIONS

Hamskea Archery Solutions, Launcher Fabric Overlay, Accessed Dec. 1, 2025, https://www.hamskeaarchery.com/shop/arrow-rest-accessories/launchers/launcher-fabric-overlay/.
Vapor Trail Archery, Victor Launcher Arm Silencer, Accessed Dec. 1, 2025, https://www.vaportrailarchery.com/VICTOR-LAUNCHER-ARM-SILENCER_p_6469.html.
Stealthy Draw, Arrow Rest Cover for QAD and Ripcord. Four Rest Covers Included. Made in The USA!!!,https://www.amazon.com/Arrow-Cover-Ripcord-Stealthy-Draw/dp/B0153R19VI/ref=sr_1_6?keywords=arrow+rest+felt&qid=1686434204&sr=8-6, published Sep. 8, 2015, Last accessed Aug. 2, 2024.
The longbowmaker store, longbowmakwe Archery Arrow Rest/Bowstring Siliencer for Recurve Bow,https://www.amazon.com/longbowmaker-Archery-Arrow-Recurve-Black-4/dp/B09QRP8R12/ref=sxin_16_pa_sp_search_thematic_sspa?content-id=amzn1.sym.e8a574bf-253e-499c-93e8-6d35a96f50eb%3Aamzn1.sym.e8a574bf-253e-499c-93e8-6d35a96f50eb&cv_ct_cx=arrow%2Brest%2Bfelt&keywords=arrow%2Brest%2Bfelt&pd_rd_i=B09QRP8R12&pd_rd_r=31bf9bee-33eb-4b28-8c43-.
The Tbest Store, Drop Away Arrow Rest,Arrow Rest Anti Slip Sticker Set,2 Set/4Pcs Archery Rest Compound Bow Shooting Hunting Accessory for QAD HDX Drop Away Compound Bow Rest Arrow Rest Felt qad integrate felt arrow, https://www.amazon.com/Sticker-Archery-Compound-Shooting-Accessory/dp/B07DW96TDT/ref=sxin_16_pa_sp_search_thematic_sspa?content-id=amzn1.sym.e8a574bf-253e-499c-93e8-6d35a96f50eb%3Aamzn1.sym.e8a574bf-253e-499c-93e8-6d35a96f50eb&cv_ct_cx=arrow+rest+felt&keywords=arrow+rest.
Arizona Archery Enterprises, Inc., Pig Hyde®, https://arizonaarchery.com/product/pig-hyde/, published at least 2020, Last accessed Aug. 2, 2024.

(Continued)

*Primary Examiner* — Reginald S Tillman, Jr.

(57) ABSTRACT

An arrow rest launcher apparatus and installation method is disclosed which comprises a multilayered sheet in various shape configurations which are adapted to install on an arrow rest launcher, the apparatus is robust and reduces the sound made by an arrow sliding along the arrow rest launcher during bow draw.

11 Claims, 14 Drawing Sheets

(56) References Cited

OTHER PUBLICATIONS

Hamskea Archery Solutions, Die Stamped Felt for Overmolded Containment Arrow Rest Launcher, https://www.hamskeaarchery.com/shop/arrow-rest-accessories/launchers/die-stamped-felt-for-overmolded-containment-arrow-rest-launcher/, Published at least as early as May 2024, Last accessed Aug. 3, 2024.
Quality Archery Designs, Laser Cut Felt Kit, https://qadinc.com/product/laser-cut-felt-kit/, Last accessed Aug. 3, 2024.

* cited by examiner

ARROW REST LAUNCHER ACCESSORY

CROSS-REFERENCE TO RELATED APPLICATIONS

U.S. Provisional application No. 63/531,040, filed on Aug. 7, 2023

BACKGROUND OF THE INVENTION

Bowhunting is an ever growing sport, with millions of registered bowhunters across the United States. Many bowhunters desire to use equipment that is as accurate as possible. Fall away arrow rests are one piece of equipment which is crucial to arrow shot accuracy. Fall away arrow rests in general, support the arrow while the bow is firing, long enough for the arrow to build its own momentum, and then the launcher falls away so that it does not contact the fletching (commonly known as vanes or feathers) of the arrow while it exits the bow. A common problem with any arrow rest, but especially fall way arrow rests, is the noise generated, via the friction of the contact between the arrow and arrow rest device, when the bow is drawn, sliding the arrow back into a launch position. This noise can easily scare game, thus foiling the bowhunters hunting efforts.

SUMMARY OF THE INVENTION

An object of the invention is to provide an arrow rest launcher apparatus which is durable and at least reduces the sound of an arrow sliding across the launcher during at least bow draw with said arrow.

In accordance with a first embodiment, of the invention relates to a material and shape which comprises a sheet comprised of a first layer of a first material adhered to a second layer of a second material, the sheet a shape which is configured to attached to, and at least partially around a first prong, second prong, and post of a bow rest launcher, where the length of first prong and the length of second prong are parallel to the length of the to the post.

In accordance with a second embodiment, of the invention relates to a material and shape which comprises a sheet comprised of a first layer of a first material adhered to a second layer of a second material, the sheet a shape which is configured to attached to, and at least partially around a first prong, second prong, and post of a bow rest launcher, where the length of first prong and the length of second prong are not parallel to the length of the to the post.

In accordance with a third embodiment, of the invention relates to a material and shape which comprises a sheet comprised of a first layer of a first material adhered to a second layer of a second material, the sheet a shape which is configured to attached to, and at least partially around a first prong, second prong, and post of a bow rest launcher, where the sheet configuration contains a central portion with a left flange and a right flange connected to the central portion as well as a bottom portion which may or may not be connected to the central portion.

ELEMENTS

Figure 1:
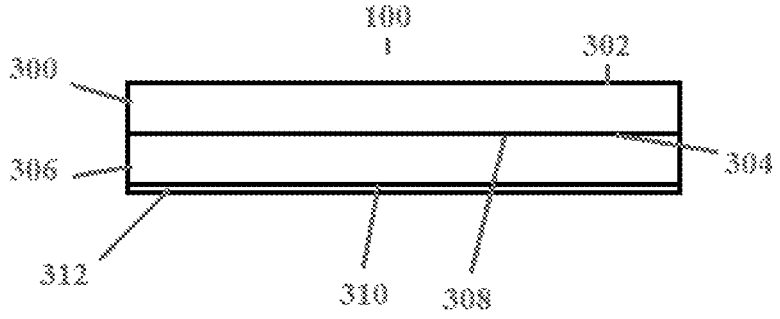
FIG. 1 a magnified side view of an embodiment of the launcher rest apparatus 100.
Figure 2:
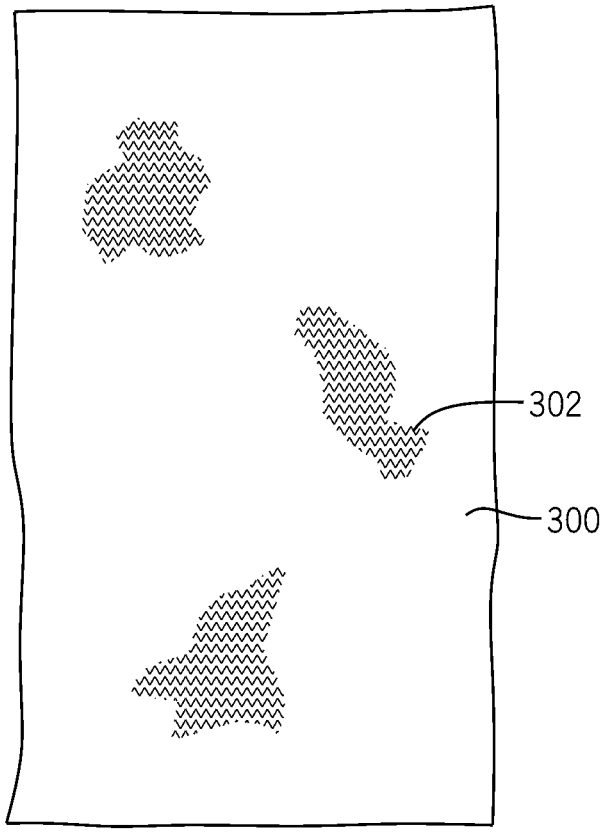
FIG. 2 is a top view of first material 300.

100 Launcher rest accessory apparatus
102 Left flange
104 Right flange
106 Central portion
108 Bottom portion
110 Aperture
112 Strap
114 Relief or slit
116 First side of central portion
118 Second side of central portion
120 Third side of central portion
122 Fourth side of central portion
124 First extension
126 Second extension
200 QAD® Ultrarest® HDX/LD/Hunter rest launcher
202 First prong
204 Second prong
206 Post
208 Ridge
210 Divot
212 First notch
214 Second notch
216 Third notch
218 Fourth notch
300 First material
302 first material top surface
304 first material bottom surface
306 Second material
308 Second material top surface
310 Second material bottom surface
312 adhesive containment layer
400 Hamskea arrow rest launcher
402 First prong
404 Second prong
406 Post
408 Ridge
410 Divot
500 Second embodiment of the invention
502 Left flange
504 Right flange
506 Central portion
508 Bottom portion
510 Aperture
512 Strap
516 First side of central portion
518 Second side of central portion
520 Third side of central portion
522 Fourth side of central portion
524 First extension
526 Second extension
600 QAD® Ultrarest® Integrate MX/R2 rest launcher
602 First prong
604 Second prong
606 Post
608 Ridge
610 First orifice
612 Second orifice
614 Third orifice
616 Fourth orifice
618 Fifth orifice
620 Sixth orifice
700 third embodiment of the invention
702 Left flange
704 Right flange
706 Central portion
708 first nub
710 second nub
712 third nub
714 fourth nub
716 bottom portion

DETAILED DESCRIPTION OF THE INVENTION

For the following defined terms, these definitions shall be applied, unless a different definition is given in the claims or elsewhere in this specification. All numeric values (if any) are herein assumed to be modified by the term "about," whether or not explicitly indicated. The term "about," in the context of numeric values, generally refers to a range of numbers that one of skill in the art would consider equivalent to the recited value (e.g., having the same function or result). In many instances, the term "about" may include numbers that are rounded to the nearest significant figure. Other uses of the term "about" (e.g., in a context other than numeric values) may be assumed to have their ordinary and customary definition(s), as understood from and consistent with the context of the specification, unless otherwise specified. Although some suitable dimensions, ranges, and/or values pertaining to various components, features and/or specifications are disclosed, one of skill in the art, incited by the present disclosure, would understand desired dimensions, ranges, and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise. It is to be noted that in order to facilitate understanding, certain features of the disclosure may be described in the singular, even though those features may be plural or recurring within the disclosed embodiment(s). Each instance of the features may include and/or be encompassed by the singular disclosure(s), unless expressly stated to the contrary.

A launcher rest accessory apparatus and method will now be described with references in FIGS. 1-26. Turning to the drawings, where the reference characters indicate corresponding elements throughout the several figures, attention is first directed to FIG. 1 where a magnified side view of an embodiment of the launcher rest apparatus is shown, illustrating its composition and the apparatus is generally indicated by reference character 100. Launcher rest apparatus 100 comprises a layer of a first material 300 with a first material top surface 302 and a first material bottom surface 304, and a layer of a second material 306 with a second material top surface 308 and a second material bottom surface 310. Second material 306 operates as an adhesive layer with both second material top surface 308 and bottom surface 310 likewise being adhesive, wherein second material top surface 308 is in communication with first material bottom surface 304 to adhere second material 306 to first material 300. Initially, launcher rest apparatus 100 may further comprise an adhesive containment layer 312 removably connected to second material bottom surface 310 which, once removed, allows launcher rest apparatus 100 to attach/adhere to an arrow rest launcher via second material bottom surface 310 (see FIG. 3 for example).

Launcher rest apparatus 100, once installed on an arrow rest launcher (which is further installed on a bow) provides significant launcher surface protection from degradation and damage due to friction created between an arrow shaft and the launcher during the repeated draw and release of arrows sliding along the launcher when engaged in archery practices. While the second material 306 ensures apparatus 100 is securely attached to a launcher (see element 200 for in FIG. 4 for example), first material 300 not only protects the launcher 200 against arrow shaft slide but also dampens and greatly reduces (or eliminates) noise created during arrow draw. This noise reduction during arrow draw is crucial as game (such as deer, elk, etc.) easily hear the noise created during draw when an arrow slides against a bare launcher, and thus often run before an accurate shot can be made, reducing the ability of an archer to hit their intended target while bow hunting. First material 300 is preferably at least partially comprised of synthetic polymer woven material (ideally at least partially comprising polyester) with the grain arranged in a direction that is parallel to the direction an arrow will be drawn/released (when apparatus 100 is applied to a launcher 200). First material 300 is further preferably a thickness between 0.025 inches and 0.030 inches, wales (width)/inch of between 17 and 25, and courses (length)/inch between 20 and 33. These material characteristics are important to ensure durability of apparatus 100 as well as crucial noise dampening/reduction when an arrow is drawn, the arrow sliding along ridge 208 during draw as well as smooth application of first material 300 to cover ridge 208. For an example see FIG. 2, which is a top view of first material 300 (as also applied to the other embodiments). Second material 306 is preferably a double sided adhesive material, ideally poly-acrylate adhesive, with a thickness (without liner/adhesive containment layer 312) between 0.00787 inches and 0.01181 inches, peel adhesion of greater than 15 N/25 mm, and shear adhesion of at least 200 g/625 $mm^2$. It is contemplated second material 306 may be created by a liquid or spray and not limited to a sheet of material. These characteristics are important to adhere to a surface of woven material with the characteristics described of first material 300 and to also adequately adhere to a launcher 200, which is often made of metal or plastic. These characteristics of second material 306 is important to ensure adequate and robust adhesion of synthetic polymer woven material to launcher 200, which is often made of metal or plastic.

Figure 3:
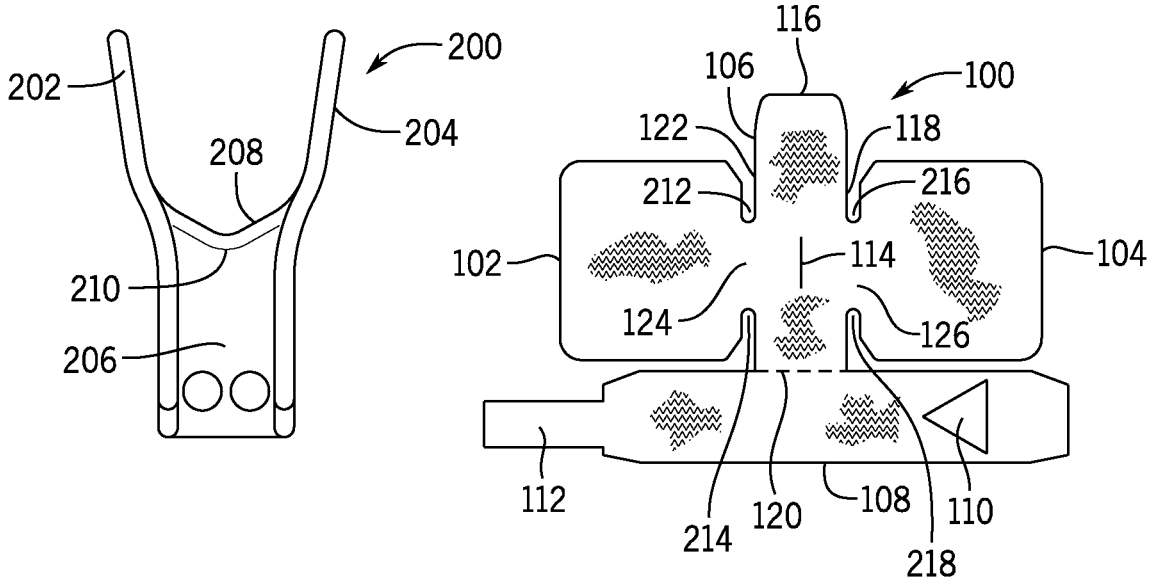
FIG. 3 is front view of an embodiment of launcher 200 and a top view of an embodiment of the invention 100.

Turning to FIG. 3, a front view of an embodiment of a launcher 200 and a top view of an embodiment of the invention 100 is shown. Launcher rest apparatus 100 comprises a shape which is defined by a left flange 102, a right flange 104, a central portion 106, and a bottom portion 108. This general shape is designed to enable launcher rest apparatus 100 to install onto most presently available brands and configurations of launcher 200 (often with some alterations as illustrated in the alternative embodiments below). Launcher 200 connects to an arrow rest mounted to a bow (not shown) in a configuration which allows an arrow to make contact with launcher 200 during arrow draw by a user. The current embodiment of apparatus 100 installs onto launcher 200, which in the current embodiment is manufactured by Quality Archery Designs (QTM, LLC) and sold as part of the QAD® Ultrarest® HDX/LD/Hunter brands arrow rests. Launcher 200 generally comprises a first prong 202 (also called an upright), a second prong 204 (also referred to as an upright), and a post 206 (generally first prong 202, second prong 204, and post 206 are, but are not required to be, formed integral with each other), where first prong 202 and second prong 204 and post 206 define a "U" shaped ridge 208 which guides an arrow and also allows the arrow to slide along said ridge 208 (primarily along a divot 210 located along the portion of ridge 208 running along post 206. Launcher rest apparatus 100 is thus configured to cover at least a portion of ridge 208 (which includes at least a portion of first prong 202, at least a portion of second prong 204, and at least a portion of post 206) to ensure that all arrows used with launcher 200 slide over first material top surface 302 of first material 300 instead of along the surface of ridge 208 of launcher 200 itself.

Central portion 106 of launcher rest apparatus 100 is generally rectangular in shape and is defined by a first side 116, a second side 118, a third side 120 (see gray dotted line in FIG. 3), and a fourth side 122 (but can be other shapes as desired to fit a particular launcher embodiment, some of which are disclosed and described below). Central portion 106 may further comprise a slit or relief 114 to assist in a smooth application of launcher rest apparatus 100 over and around ridge 208 without air pockets, wrinkles, or ruffles in apparatus 100 which could cause a shot arrow to propel into an undesired direction. In the current embodiment relief 114 is a slit and is preferably centrally located between second side 118 and fourth side 122 and extends parallel to second side 118 and fourth side 122 of central portion 106 but can be a different shape/configuration. Left flange 102 is preferably connected to fourth side 122 of central portion 106, but may be separate (see FIG. 14) if required for a particular launcher. Right flange 104 is preferably connected to second side 118 of central portion 106, but may also be separate (see FIG. 14). Bottom portion 108 is connected to third side 120 of central portion 106 but may also be separate if desired. Central portion 106, left flange 102, right flange 104, and bottom portion 108 in the current generally embodiment are formed integral together, but 1 or more elements could be separate if desired. Bottom portion 108 is generally rectangular shaped and further comprises a strap 112 extending from one end/side along the length of bottom portion 108 and an aperture 110 formed therethrough the opposing end along the length of bottom portion 108, wherein aperture 110 has a diameter that is at least the width of strap 112 and configuration so at least a portion of strap 112 can extend through aperture 110. Further, left flange 102 and right flange 104 are mirror images of each other and may be located in line with one another (but are not required to be as they can each be other shapes and configurations for a particular launcher) when attached to central portion 106. Left flange 102 and right flange 104 are generally square or rectangular shaped and aligned along their length parallel with central portion 106 along its length. Left flange 102 further comprises a first extension 124 which connects left flange 102 to central portion 106, defining a first notch 212 and a second notch 214, and right flange 104 further comprises a second extension 126 which connects right flange 104 to central portion 106 and defines a third notch 216 and a fourth notch 218. First extension 124 and second extension 126 are generally rectangular shaped as well but can be another shape to serve the same purpose.

Figure 4:
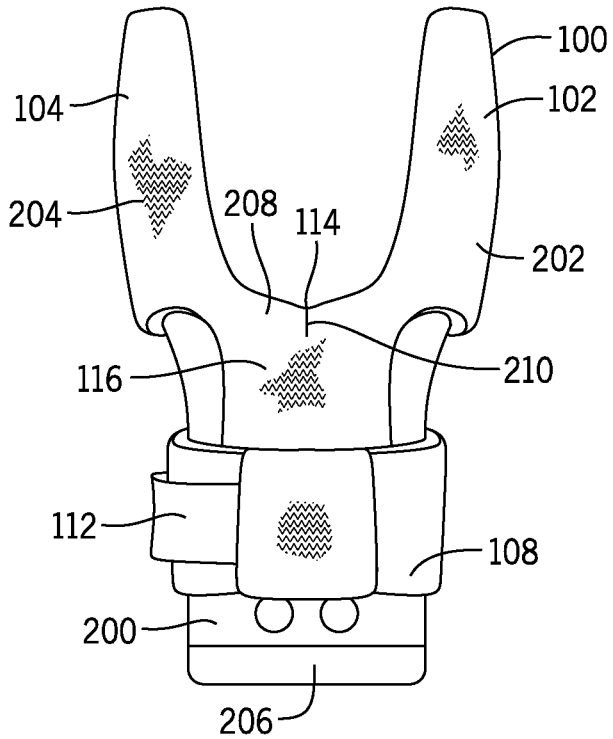
FIG. 4 is a rear view of an embodiment of launcher 200 with an embodiment of the invention 100 applied.

Turning to FIG. 4, a rear view of an embodiment of launcher 200 with an embodiment of the invention 100 installed on it is shown. Launcher rest apparatus 100 is removably (or permanently/semi-permanently if desired) attached to launcher 200 via adhesive second material 306 (by second material bottom surface 310 specifically). Once apparatus 100 is installed onto launcher 200 (a process which will be detailed below), left flange 102 wraps around first prong 202, right flange 104 wraps around second prong 204, while central portion 106 attaches to at least a portion of post 106, covering divot 210 and ridge 208 (that is the portion of ridge 208 forming a portion of post 106 wherein right flange 104 covers the portion of ridge 208 forming a portion of second prong 104 and left flange 102 covers the portion of ridge 208 forming a portion of second prong 102). If apparatus 100 includes a relief 114, it will straddle divot 210 (wherein the center of relief 114 aligns with the center of divot 210 forming a portion of ridge 208) and provides a smooth surface along ridge 208 once apparatus 100 is fully applied/covering ridge 208. Further, bottom portion 108 wraps around at least a portion of post 206 in a perpendicular configuration to that of attached central portion 106. Bottom portion 108 is further secured to post 108 by strap 112 extending through aperture 110 and adhering (via second material bottom surface 310) to a portion of first material top surface 302 of bottom portion 108. This ensures launcher rest apparatus 100 securely stays fastened to launcher 200 and prevents failure due to repeated draw and release operations by a user.

Figure 5:
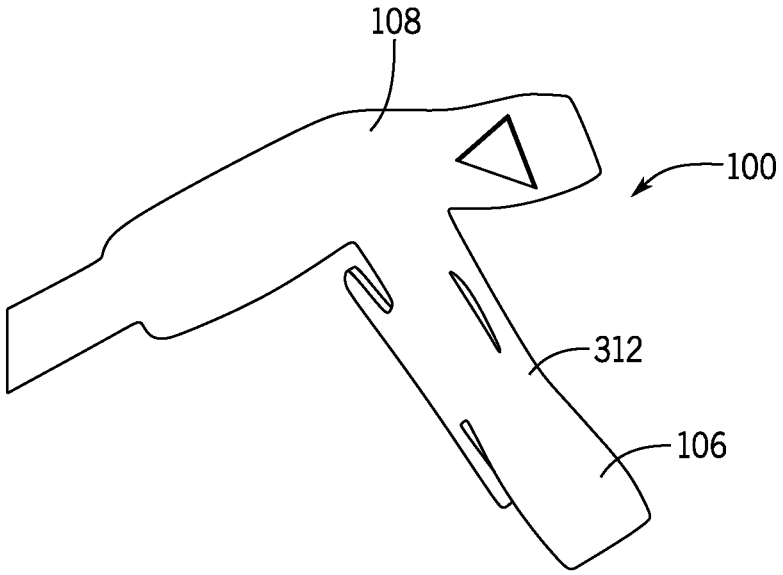
FIG. 5 is a perspective view of the bottom of an embodiment of the invention 100 bent.
Figure 6:
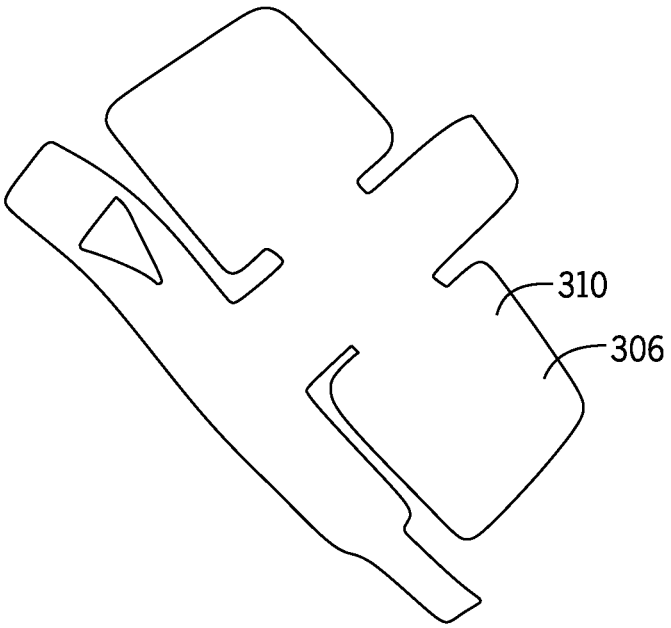
FIG. 6 is a bottom view of an embodiment of the invention 100 with adhesive containment layer 312 removed.
Figure 7:
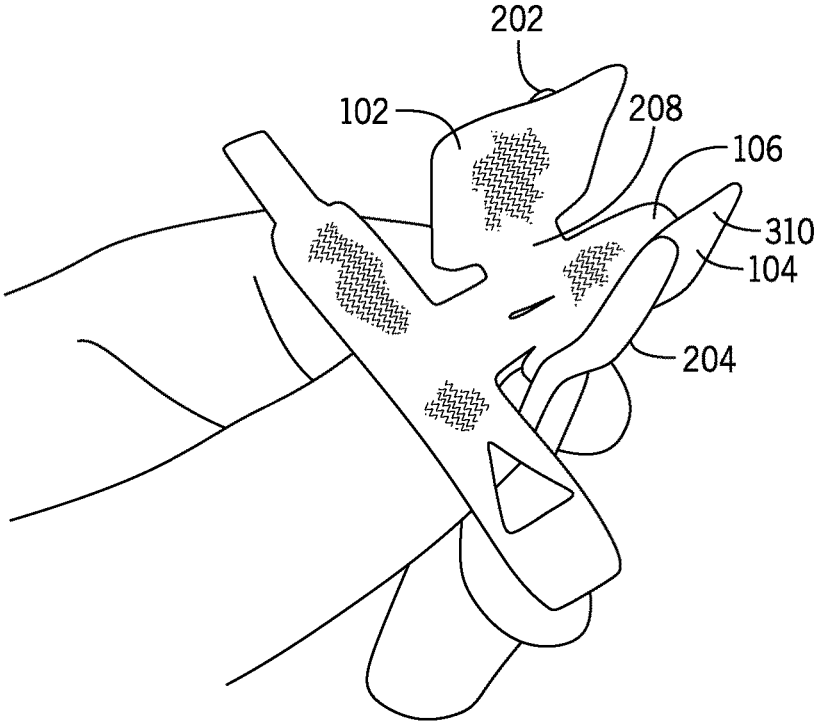
FIG. 7 is a perspective view illustrating an embodiment of invention 100 with second material 306 adhered to launcher 200.
Figure 8:
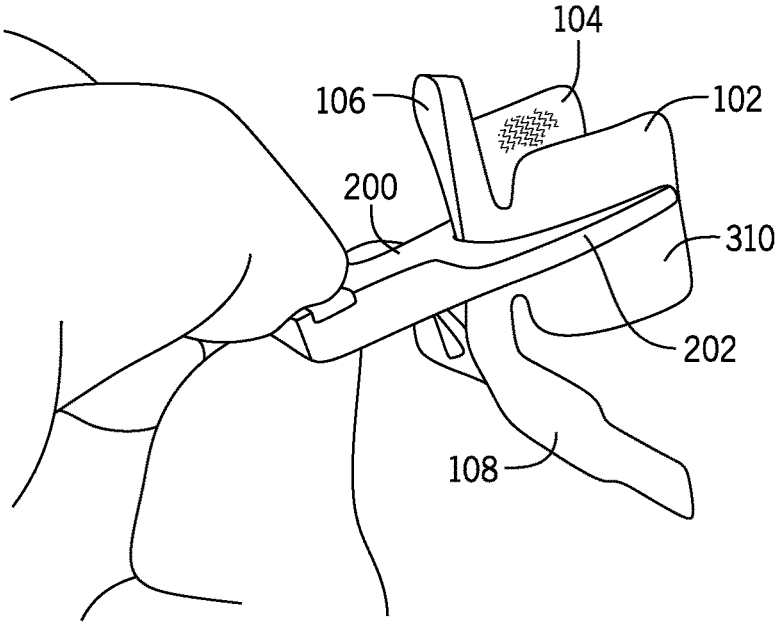
FIG. 8 is a side view of an embodiment of the invention 100 of FIG. 7.
Figure 9:
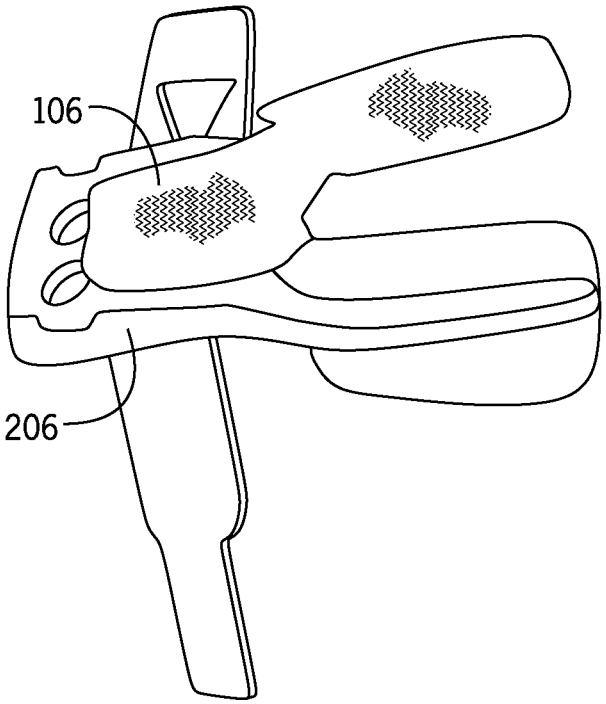
FIG. 9 is a perspective view of an embodiment of the invention 100 with bottom portion 108 partially adhered to post 100.
Figure 10:
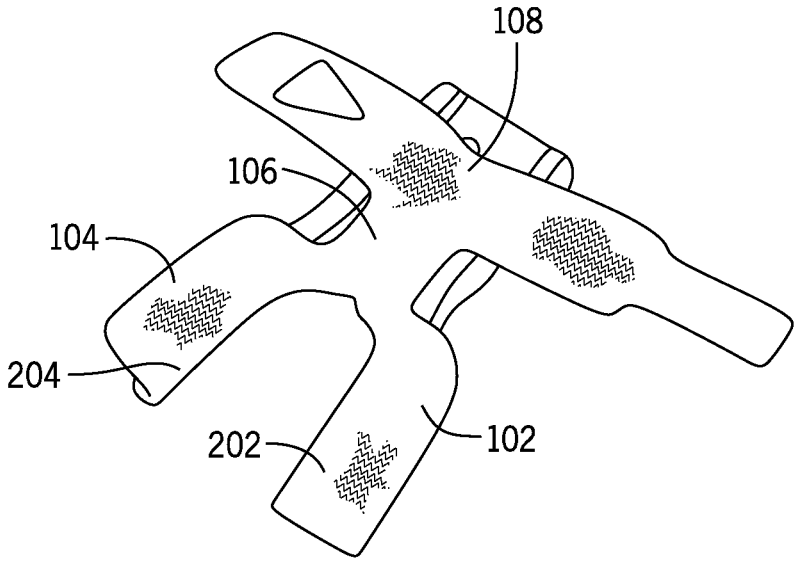
FIG. 10 is a perspective view illustrating at least a portion of left flange 102 adhered at least partially to first prong 202 and right flange 104 adhered at least partially to second prong 204.
Figure 11:
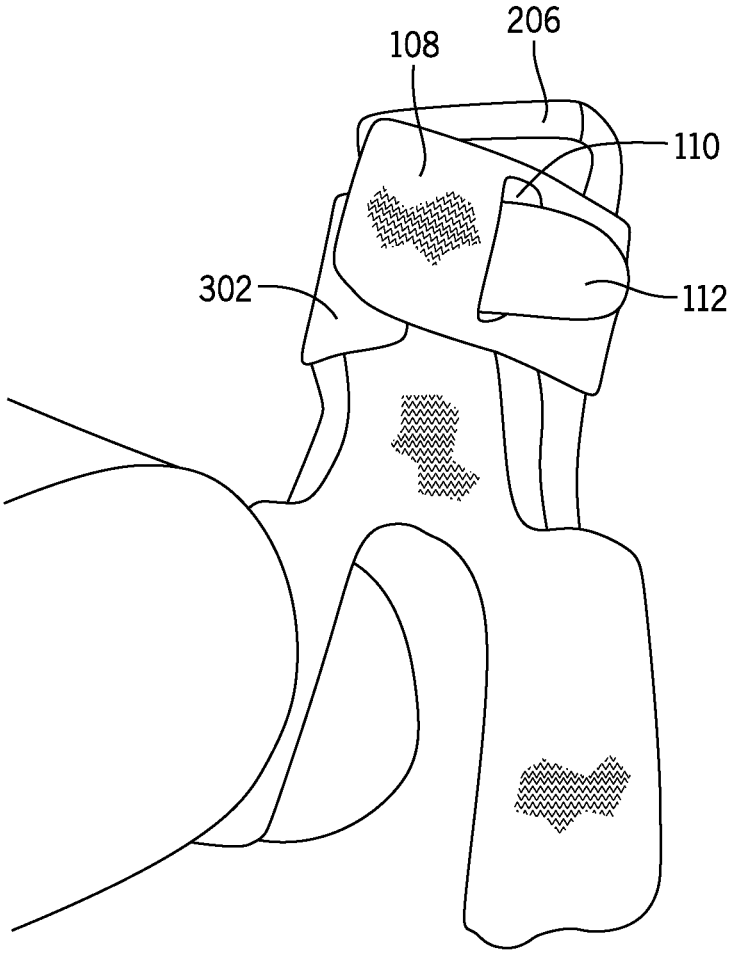
FIG. 11 is a perspective view illustrating strap 112 extending through aperture 110 of bottom portion 108 during installation on launcher 200.

Turning to FIGS. 5-12, perspective views illustrating the process of installing an embodiment of the invention to launcher 200 is shown. As shown in FIGS. 5 and 6, installation of launcher rest apparatus 100 to launcher 200 begins with peeling away adhesive containment layer 312 to expose adhesive second material 306 and second material bottom surface 310. Next, as shown in FIGS. 7 and 8, second material bottom surface 310 is applied to ridge 208 of launcher 200 (via pressure). More specifically, at least a portion of second material bottom surface 310 located on left flange 204 (preferably centrally located along the width of left flange 204), right flange 204 (preferably centrally located along the width of right flange 204), and central portion 106, wherein relief 114 is centrally located on, and positioned perpendicular to, ridge 208 (specifically the portion of ridge 208 comprising divot 210). Turning to FIG. 9, the rest of central portion 106 (and a central area of bottom portion 108) is secured (via pressure) to post 206 via second material bottom surface 310. Next, as shown in FIG. 10, left flange 102 is folded onto itself to at least partially enclose first prong 202 and right flange 104 is folded onto itself to at least partially enclose second prong 204. Any excess material is trimmed away by a sharp object such as a scissors or knife. Any remaining edges post cut can be sealed with a heating element or similar if desired. Turning to FIG. 11, the rest of bottom portion 108 is then secured around post 206 (via pressure) with strap 112 being pulled through aperture 110 and secured to first material top surface 302 of bottom portion 108. Bottom portion 108, when wrapped around post 206 provides additional support to ensure apparatus 100 stays secured to launcher 200 even after repeated use with arrows. After installation, apparatus 100 and launcher 200 will appear as shown in FIG. 4 and launcher 200 is ready for installation in an arrow rest of a bow.

Figure 12:
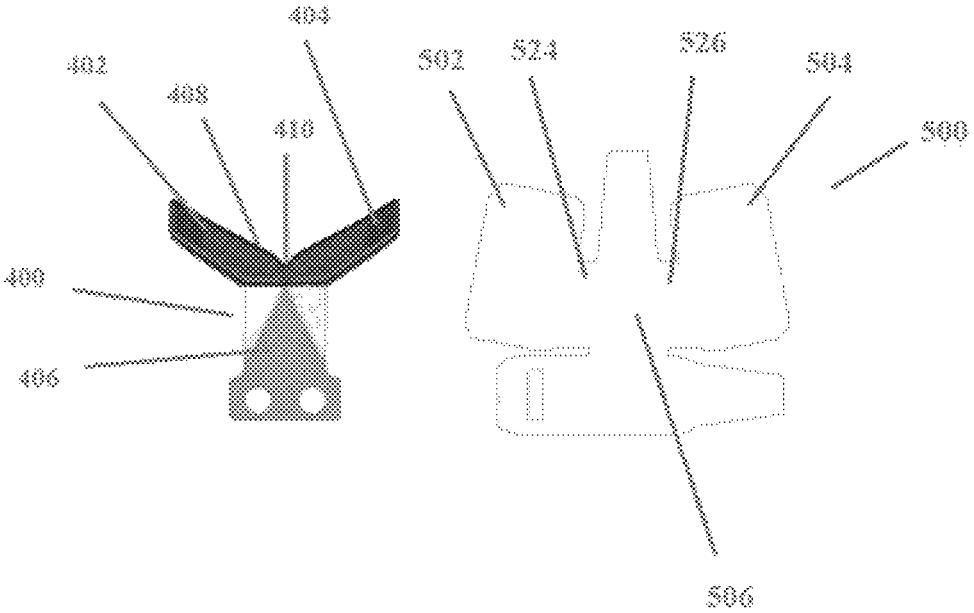
FIG. 12 is a front view of a second embodiment of a launcher 400 and a top view of a second embodiment of the invention 500.

Turning to FIG. 12, a front view of a second embodiment of a launcher 400 and a top view of a second embodiment of invention 500 is shown. Launcher 400 is similar to launcher 200 in many ways. Launcher 400 generally comprises a first prong 402, a second prong 404, and a post 406 (all generally formed integral with each other but not required to be), where the first prong 402 and second prong 404 and post 406 define a "V" shaped ridge 408 (instead of a "U" shape) which guides an arrow during bow draw and release, and also allows it to slide along said ridge 408 (primarily along a divot 410 located along the portion of ridge 408 running along post 406. Second embodiment of launcher rest apparatus 500 is comprised of the same materials and material configuration as launcher 100 (see FIG. 1 and description above) however the general overall shape is different. Second embodiment of launcher rest apparatus 500 comprises a left flange 502 connected to a central portion 506 via a first extension 524, however left flange 502 and right flange 504 are generally rectangular shaped and in a mirrored configuration to each other, although they are arranged lengthwise at an angle in relation to central portion 506 (they are not parallel lengthwise with central portion 106 along its length as in the first embodiment of apparatus 100). Generally left flange 502 and right flange 504 are angled, along their lengths, toward central portion 106. Another difference is central portion 506 is generally trapezoid shaped instead of rectangular, for the purpose of generating a smooth planar covering of ridge 408 by apparatus 500 it is applied to launcher 400. Launcher 400 is manufactured by the Hamskea Archery Solutions company and sold under the Epsilon brand name. Installation of apparatus 500 to launcher 400 is the same as described above in regard to installation of apparatus 100 to launcher 200.

Figure 13A:
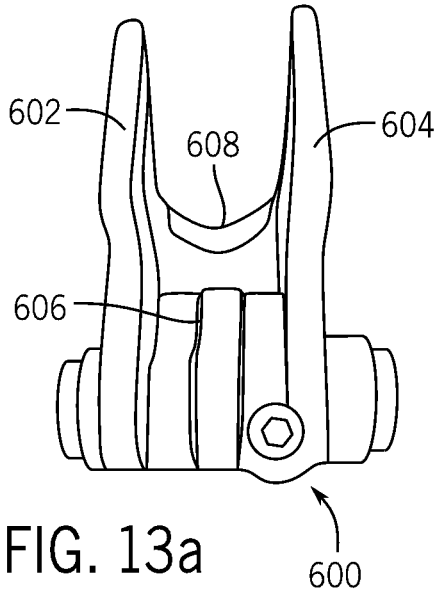
FIG. 13*a* is a front view of third embodiment of a launcher 600.
Figure 13B:
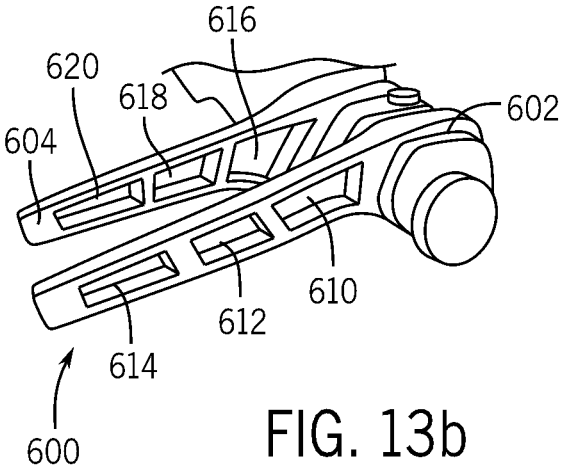
FIG. 13*b* is a perspective left side view of third embodiment of a launcher 600.
Figure 14:
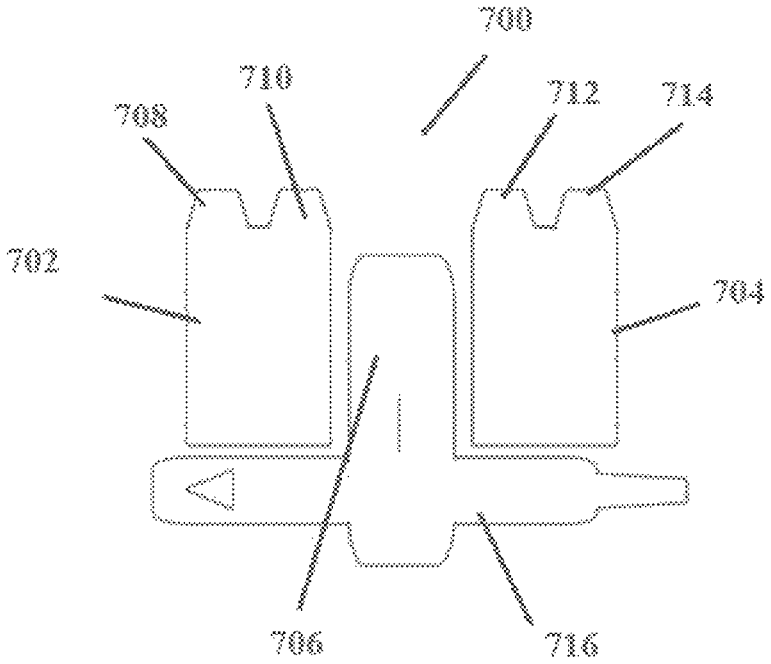
FIG. 14 is a top view of a third embodiment of the invention 700.
Figure 15:
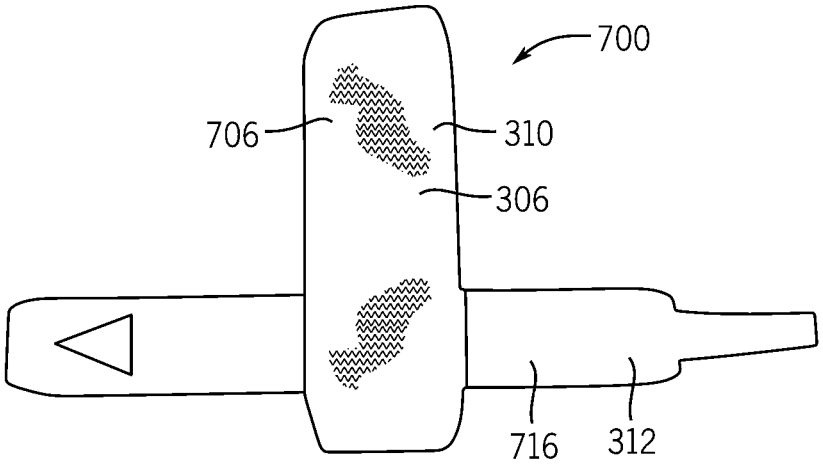
FIG. 15 is a perspective view illustrating the process of installing the third embodiment of the invention 700 to the third embodiment of launcher 600.
Figure 16:
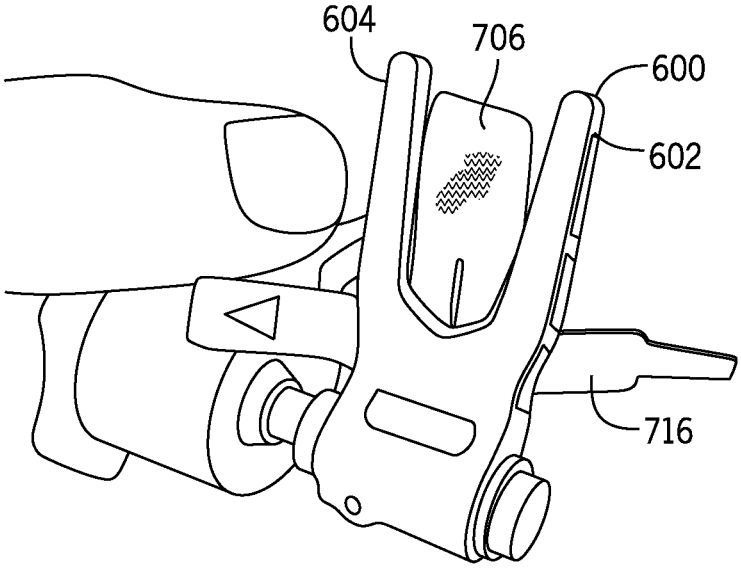
FIG. 16 is a perspective view illustrating the process of installing the third embodiment of the invention 700 to the third embodiment of launcher 600.
Figure 17:
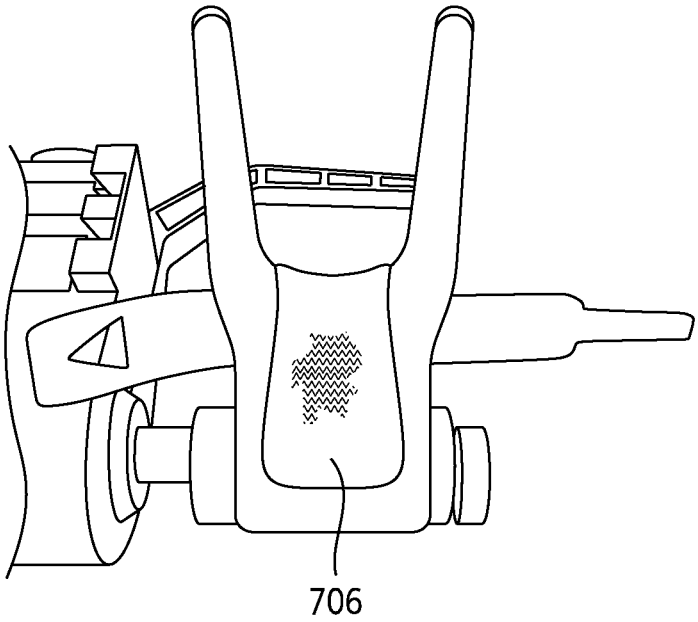
FIG. 17 is a perspective view illustrating the process of installing the third embodiment of the invention 700 to the third embodiment of launcher 600.
Figure 18:
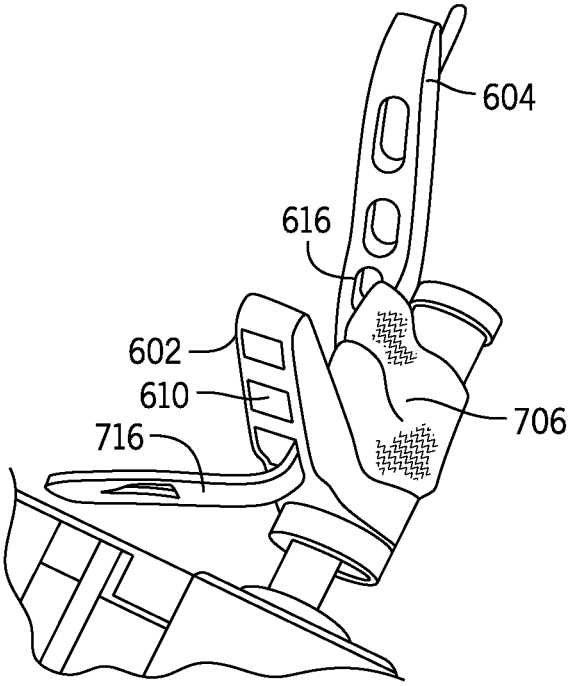
FIG. 18 is a perspective view illustrating the process of installing the third embodiment of the invention 700 to the third embodiment of launcher 600.
Figure 19:
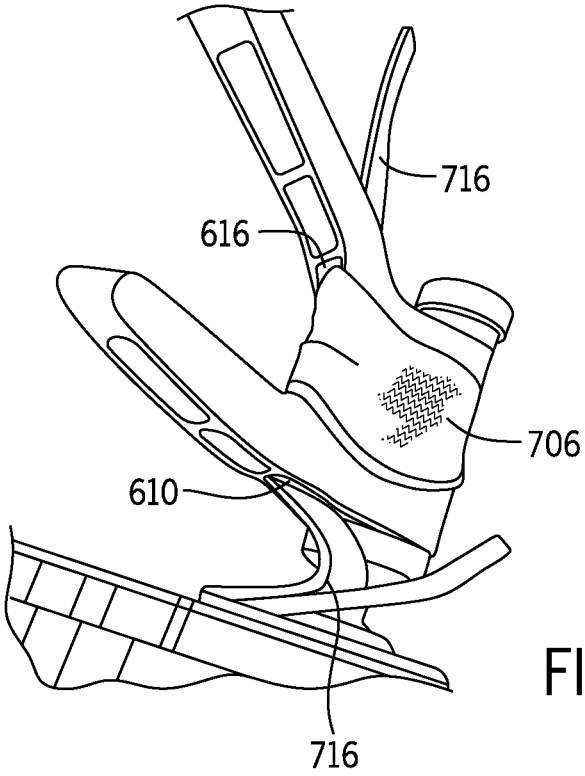
FIG. 19 is a perspective view illustrating the process of installing the third embodiment of the invention 700 to the third embodiment of launcher 600.
Figure 20:
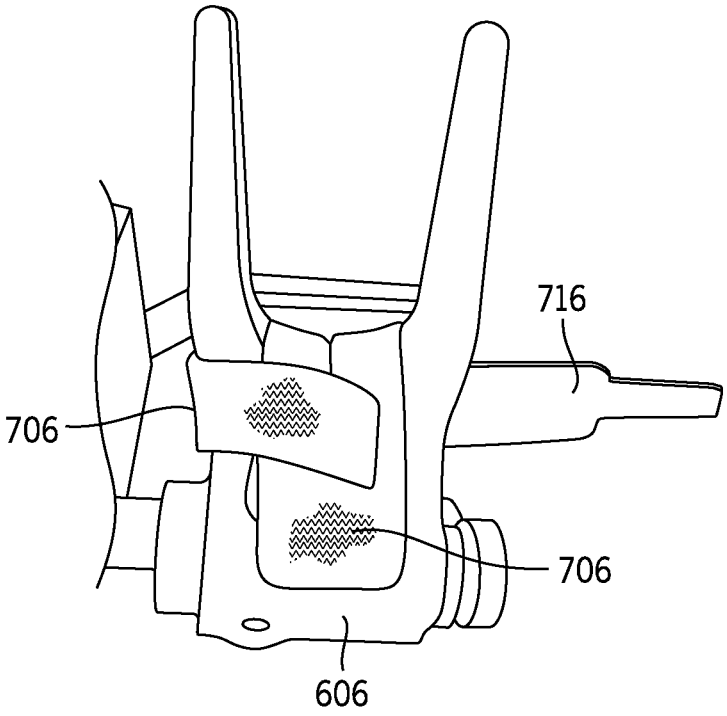
FIG. 20 is a perspective view illustrating the process of installing the third embodiment of the invention 700 to the third embodiment of launcher 600.
Figure 21:
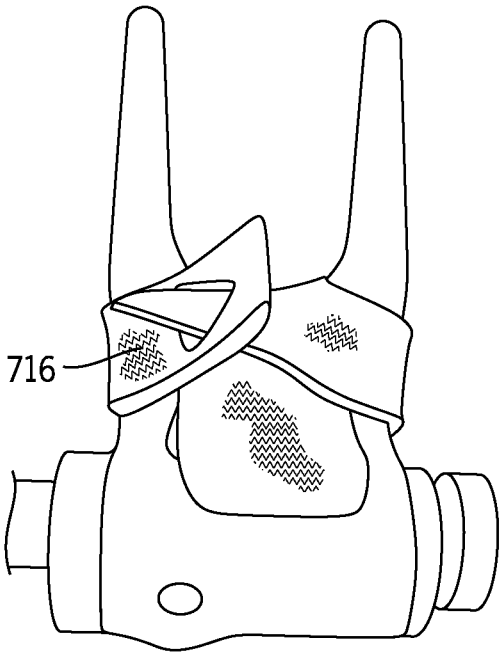
FIG. 21 is a perspective view illustrating the process of installing the third embodiment of the invention 700 to the third embodiment of launcher 600.
Figure 22:
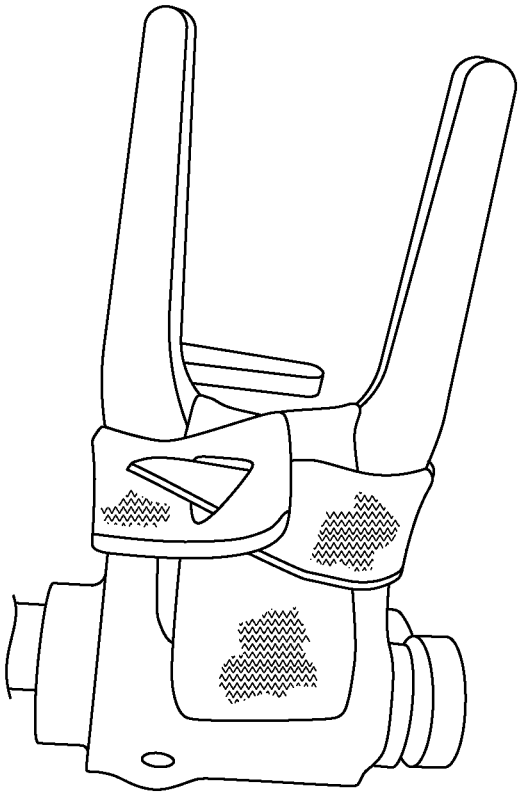
FIG. 22 is a perspective view illustrating the process of installing the third embodiment of the invention 700 to the third embodiment of launcher 600.
Figure 23:
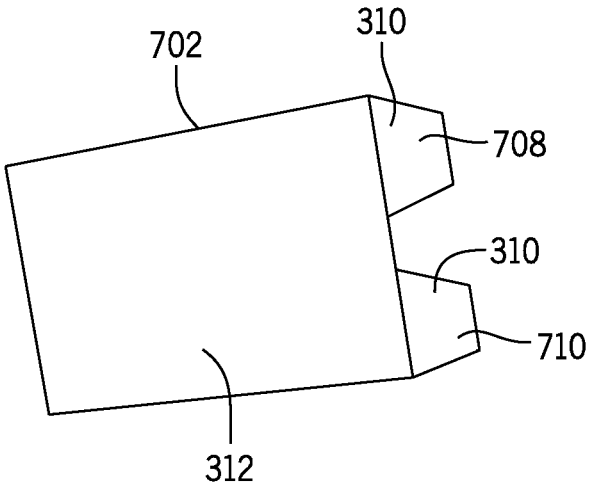
FIG. 23 is a perspective view illustrating the process of installing the third embodiment of the invention 700 to the third embodiment of launcher 600.
Figure 24:
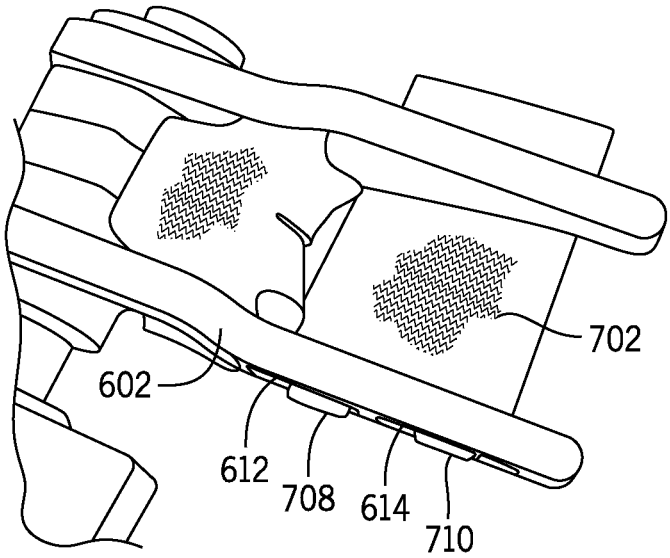
FIG. 24 is a perspective view illustrating the process of installing the third embodiment of the invention 700 to the third embodiment of launcher 600.
Figure 25:
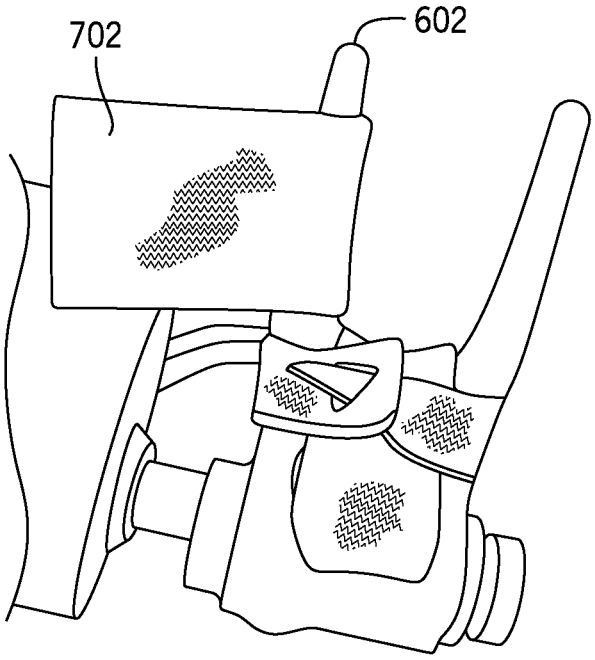
FIG. 25 is a perspective view illustrating the process of installing the third embodiment of the invention 700 to the third embodiment of launcher 600.
Figure 26:
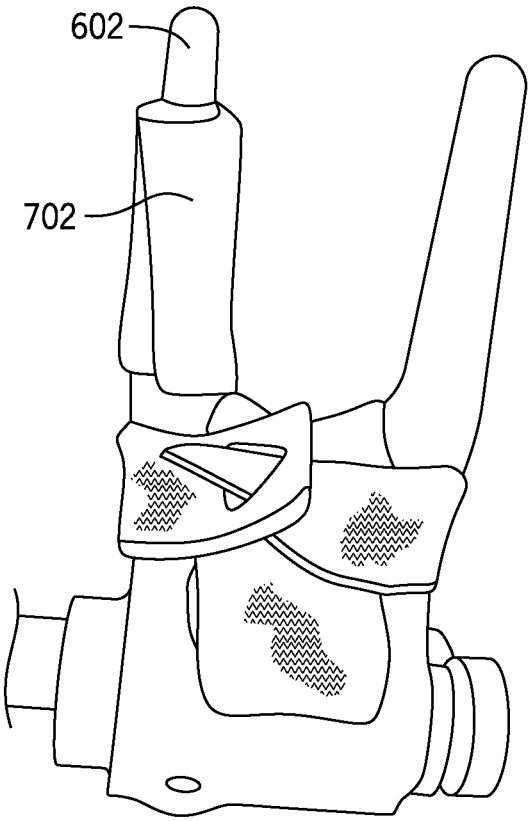
FIG. 26 is a perspective view illustrating the process of installing the third embodiment of the invention 700 to the third embodiment of launcher 600.

Turning to FIGS. 13*a* and 13*b* front view and a left side perspective view of a third embodiment of a launcher 600 is shown. Also turning to FIG. 14, a top view of a third embodiment of the invention 700 is shown which is configured to apply to launcher 600. Launcher 600 is sold as part of the QAD® Ultrarest® Integrate MX/R2 arrow rest and is a similar in configuration to launcher 200 and launcher 400 in that it comprises a first prong 602, a second prong 604 and a post 606 where first prong 602 and second prong 604 are connected to opposing sides of post 606 and together define a ridge 608 that is "U" shaped, upon which apparatus 700 is applied over. One difference however is that prong 602 further comprises a first orifice 610, a second orifice 612, and a third orifice 614 formed therethrough first prong 602. First, second, and third orifices 610, 612, and 614 extend perpendicular to the length of prong 602 and are arranged in line with one another. Likewise, second prong 604 also comprises a fourth orifice 616, fifth orifice 618, and sixth orifice 620 formed therethrough and extend perpendicular to the length of prong 604 (and are also in line with one another). As shown in FIG. 14, this embodiment of apparatus 700 is similar to apparatus 100 and apparatus 500 in that apparatus 700 has the same material composition but its shape is defined by comprises a shape which is defined by a left flange 702, a right flange 704, a central portion 706, and a bottom portion 716, however apparatus 700 comprises a left flange 702 and right flange 704 that are separate from central portion 706. Further, left flange is generally rectangular in shape but also comprises a first nub 708 and a second nub 710 both located in line with one another and extending in the same direction away from one side of the left flange 702. Likewise, right flange 704 also comprises a third nub 712 and a fourth nub 714 in the same configuration as first nub 708 and second nub 710. Each nub 708, 710, 712, and 714 are the same shape, either rectangular, triangular, or trapezoidal or other shape and spacing as desired. In addition, bottom portion 716 of apparatus 700 is configured to extend through both first orifice 610 of first prong 602 and fourth orifice 616 of second prong 604 (see FIG. 18).

Turning to FIGS. 15-26, perspective views illustrating the process of installing the third embodiment of the invention 700 on a third embodiment of launcher 600 is shown. Installation of apparatus 700 to launcher 600 is similar to the other installation methods described, however there are a few differences to note. As shown in FIGS. 23-26 first nub 708 of left flange 702 is configured to extend through second orifice 612 wherein adhesive containment layer 312 is removed from first nub 708 and second material bottom surface 310 is pressed against one of the sides of second orifice 612, and second nub 710 extends through third orifice 614 and adhesive containment layer 312 is removed from second nub 710 and second material bottom surface 310 is pressed against one of the sides of orifice 710. Next, adhesive containment layer 312 is removed from the rest of left flange 702 and left flange 702 is wrapped around first prong 602 so that second material bottom surface 310 adheres to first prong 602 and then to first material top surface 302 on subsequent wraps of left flange 702 around first prong 602. This process is repeated for right flange 704 and second prong 604 (not shown in the figures). That is, third nub 712 extends (and is adhered to) fifth orifice 618 and fourth nub 714 extends through (and is adhered to) six orifice 620. As nubs 708, 710, 712, and 714 are the same shape and left flange 702 and right flange 704 are preferably the same overall shape, either flange may be installed on either first prong 602 or second prong 604 and can also be flipped for installation. For example, first nub 708 could be installed in third orifice 614 (and then second nub 710 would be installed in second orifice 612).

While the present invention has been described above in terms of specific embodiments, it is to be understood that the invention is not limited to these disclosed embodiments. Many modifications and other embodiments of the invention will come to mind of those skilled in the art to which this invention pertain, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings. Likewise, where this document refers to technologies that would be apparent or known to one of ordinary skill in the art, such technologies encompass those apparent or known to the skilled artisan now or at any time in the future.

Ultrarest® and QAD® are registered trademarks owned by QTM, LLC

The invention claimed is:

1. An arrow rest launcher apparatus comprising:

a sheet comprising:

a first layer comprising a first material with a first material top surface and a first material bottom surface; and a second layer with a second material top surface and a second material bottom surface, the second material top surface adhered to the first material bottom surface and configured to at least partially adhere to an arrow rest launcher, wherein the sheet further comprises:

a central portion comprising a first side, a second side, a third side, and a fourth side, the fourth side located opposite the second side;

a right flange connected to a second side of the central portion;

a bottom portion comprising at least two ends and connected to a third side of the central portion and arranged perpendicular to the central portion; and a left flange connected to fourth side of the central portion.

2. The apparatus of claim 1 wherein the first material is comprised of a synthetic polymer woven material.

3. The apparatus of claim 1 where the first material is between 0.025 inches and 0.030 inches thick.

4. The apparatus of claim 1 where the first material is between 17 and 25 wales per inch.

5. The apparatus of claim 1 where the first material is between 20 and 33 courses per inch.

6. The apparatus of claim 1 wherein the second material is comprised of a poly-acrylate adhesive.

7. An arrow rest launcher apparatus comprising:

a sheet comprising:

a first layer comprising a first material with a first material top surface and a first material bottom surface; and a second layer with a second material top surface and a second material bottom surface, the second material top surface adhered to the first material bottom surface, wherein the sheet further comprises:

a central portion comprising a first side, a second side, a third side, and a fourth side, the fourth side located opposite the second side;

a right flange configured to wrap at least partially around a first prong of an arrow rest, the right flange connected to a second side of the central portion;

a bottom portion configured to wrap at least partially around a post of an arrow rest, the bottom portion connected to a third side of the central portion and arranged perpendicular to the central portion; and a left flange configured to wrap at least partially around a second prong of an arrow rest, the left flange connected to fourth side of the central portion.

8. The apparatus of claim 7 wherein the bottom portion further comprises an aperture formed therethrough one end and a strap portion attached to the opposite end.

9. The apparatus of claim 7 wherein the strap tightens bottom portion around a post of an arrow rest by pulling strap portion through the aperture.

10. The apparatus of claim 7 wherein the central portion further comprises at least one relief formed therethrough.

11. A method for connecting an arrow rest launcher apparatus comprising a sheet comprising a first layer and a second layer with a bottom surface, the sheet comprising a central portion, left flange, right flange, and bottom portion to an arrow rest launcher with a first prong, second prong, and post, the method comprising: peeling away an adhesive containment layer connected to the second material bottom surface; applying the second material central portion at least partially around the post; applying the second material bottom surface of the left flange at least partially around the first prong; applying the second material bottom surface of the right flange at least partially around the second prong; and applying the second material bottom surface of the bottom portion at least partially around the post, wherein the bottom portion further comprises an aperture and a strap, the method further including the step of pulling at least a portion of the strap through the aperture to tighten bottom portion around the post.

* * * * *